United States Patent [19]

Lawrence

[11] Patent Number: 4,896,685

[45] Date of Patent: Jan. 30, 1990

[54] BABY BOW HAIR FASTENER

[75] Inventor: Gary D. Lawrence, Ft. Worth, Tex.

[73] Assignee: Globestar, Incorporated, Fort Worth, Tex.

[21] Appl. No.: 212,602

[22] Filed: Jun. 28, 1988

[51] Int. Cl.[4] ..... A45D 8/22

[52] U.S. Cl. ..... 132/278; 132/276

[58] Field of Search ..... 132/273, 275, 276, 277, 132/278, 279

[56] References Cited

U.S. PATENT DOCUMENTS

| | | | |
|---|---|---|---|
| 1,091,936 | 3/1914 | Lange | 132/275 |
| 2,660,826 | 12/1953 | Bennett | 132/275 |
| 2,699,789 | 1/1955 | Goodman | 132/275 |
| 2,818,871 | 1/1958 | Beaudry | 132/278 |

FOREIGN PATENT DOCUMENTS

| | | | |
|---|---|---|---|
| 0607278 | 6/1926 | France | 132/279 |

*Primary Examiner*—Gene Mancene

*Assistant Examiner*—Adriene J. Lepiane

*Attorney, Agent, or Firm*—Hubbard, Thurman, Turner, Tucker & Harris

[57] ABSTRACT

A decorative baby hair piece has a decorative adornment of embroidered ribbon attached to a lace backing element or a large bow without the backing element and a hair lock attached with glue to the decorative adornment. The hair lock includes two elongated, flexible, plastic strips having ends laser welded together and opposite ends left open. The open ends facilitate positioning baby hair between opposing surfaces of the two strips. Elongated male and female flexible plastic elements having corresponding lock forming shapes are formed integrally with the two strips and coact when pressed together to form a zipper type lock. Thus, with baby hair positioned across the male and female locking elements and the plastic strips pressed together to zip lock the locking elements together, the hair and the strips are simultaneously locked together for securing the decorative baby hair piece to the baby's hair.

2 Claims, 1 Drawing Sheet

BABY BOW HAIR FASTENER

This invention relates to decorative hair fasteners and more particularly to a decorative baby hair piece with improved fastener.

BACKGROUND OF THE INVENTION

Many problems attend the use of decorative hair barrettes designed for use with babies. These problems stem either directly or indirectly to the fastener designs. Baby hair is frequently very short and finely textured. Available fasteners simply are not capable of being fastened to such baby hair in a manner preventing their loss. Prior art solutions have been directed to the development of inexpensive fasteners, the cost of which is not prohibitive of replacement. Efforts were also made to develop an inexpensive fastener which will remain secured to the baby's hair regardless of its length or texture. That is, designs so inexpensive the loss of the device is tolerable. Efforts to develop inexpensive hair fasteners have included the use of Velcro fasteners. The problem with Velcro fasteners is that, while, the synthetic material adheres when pressed together, the hair between them is not held securely and the barrette slips off.

Another inexpensive fastener is a hair barrette which includes a pressure-molded polyethylene strip having a centrally located natural hinge for folding the strip back over itself to form first and second portions. One end of the strip has a hole formed therein, and the opposite end has a compressible member formed thereon for insertion into the hole and expansion to lock the two portions together at the ends. A surface of the first portion includes a plurality of laterally spaced ribs, and a surface of the second portion includes a plurality of ribs which are in a nonaligned relation with the opposing ribs on the first strip. Thus, when brought together with hair inbetween and locked by the locking means, the hair is positively engaged by the cooperating ribs and clamped therebetween. Those persons skilled in the art desiring more information about the hair barrette described immediately above are referred to U.S. Pat. No. 2,818,871 issued Jan. 7, 1958 to John R. Beaudry.

A disadvantage of the hair barrette stems from the locking mechanism. As the locking mechanism is located at the ends of the two portions, the ribs of the two portions are not necessarily locked together continuously along their lengths. The result is slippage of the hair barrette and possible loss.

BRIEF SUMMARY OF THE INVENTION

Accordingly it is an object of the invention to provide an inexpensive baby hair decorative piece of improved construction.

Another object of the invention is to provide an inexpensive baby hair decorative piece which is easy to assemble using mass production techniques.

Still another object of the invention is to provide a baby hair decorative piece which is simple to attach to baby hair and when attached performs in an improved manner.

Yet another object of the invention is to provide an improved baby hair decorative piece having a locking feature for combining the action of locking the piece while simultaneously securing the baby hair in the piece.

Briefly stated the baby hair decorative piece constituting the subject matter of the invention includes a hair decoration attached to flexible, locking elements. The locking elements lock when pressed together and simultaneously therewith secure hair positioned transversely therebetween.

BRIEF DESCRIPTION OF THE DRAWINGS

These and other objects and advantages of the invention will become more readily apparent from the following detailed description when read in conjunction with the accompanying drawings in which.

DETAILED DESCRIPTION OF THE PREFERRED EMBODIMENTS

Figure 1:
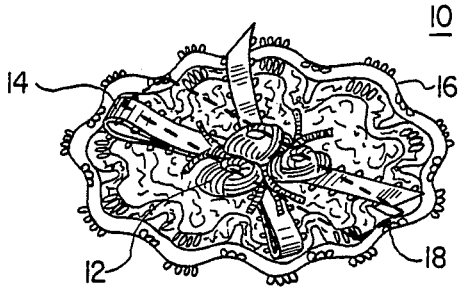
FIG. 1 is an isometric view of a decorative baby hair piece constituting a first embodiment of the invention.

Referring now to FIG. 1, the decorative baby hair piece 10 of a first embodiment of the invention includes a decorative adornment 12 to which a hair locking means or clasp 18 is attached by glue, for example. The decorative adornment 12 may be of many and various shapes and sizes one of which is a flower embroidered ribbon 14 tied as shown in FIG. 1 with a lace, for example, backing element 16 secured to the adornment piece 12 for supporting the decorative adornment on a first side. The hair locking means 18 is secured on the opposite side of the backing element. The backing element 16 also acts to shield the locking means from view. As shown in FIG. 1, the backing element is a lace. The hair locking means or clasp 18 includes two flexible, clear plastic strips having opposing elongated, flexible female and male elements which with baby hair positioned transversely thereof are to be engaged inside one another under pressure to ensure closing and locking to the baby hair. The clasp will be described more completely hereinafter in connection with a second embodiment.

Figure 2:
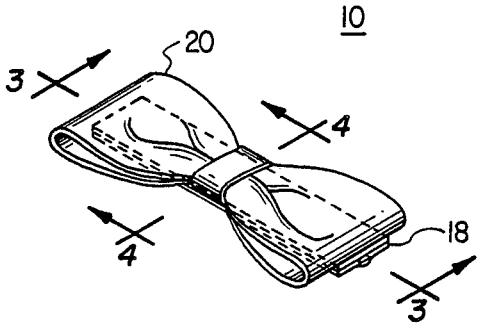
FIG. 2 is an isometric view of a second embodiment of the invention.

Referring now to FIG. 2 for a description of a second embodiment of the decorative baby hair piece 10, the decorative adornment is a pretied bow 20 of a size and strength such that a backing element is not required. Thus, the hair locking means 18 is attached directly to the decorative bow. Nevertheless, it will be appreciated that a bow can be used with a backing element if desired.

Figure 3:
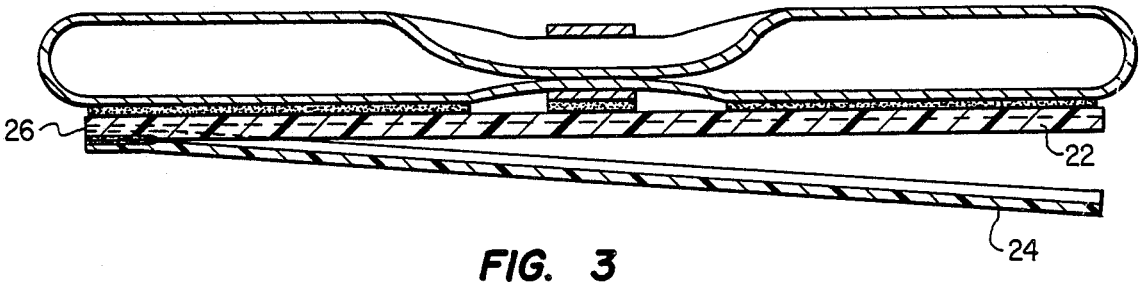
FIG. 3 is a cross sectional view taken along line 3—3 of FIG. 2 of the decorative baby hair piece of the second embodiment.
Figure 4:
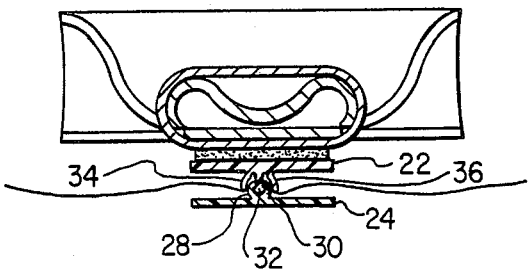
FIG. 4 is a cross sectional view taken along line 4—4 of FIG. 2 showing the decorative baby hair piece of the second embodiment.

Referring now to FIG. 3 for a description of the hair locking means 18, the hair locking means 18 includes first and second elongated, flexible, plastic strips 22 and 24. The strips 22 and 24 each have first ends 26 which are joined together. A laser welder is used to weld the ends of the plastic strips together. The laser welder melts the plastic ends together and upon cooling the melted ends resolidify to permanently join the ends with the strips folded over each other. The first plastic strip 22 has first and second opposing surfaces. The first surface is fixed to the decorative adornment 12. When a backing element 16 such as the lace of the first embodiment is included, the first surface is fixed thereto by gluing, and when a backing element is not included for the adornment such as the bow as shown in FIG. 2, the first surface of the first plastic strip is glued directly to the decorative adornment.

The first and second plastic strips have elongated, flexible female and male locking elements on opposing inner surfaces, which are to be engaged inside one another under pressure to simultaneously lock baby hair therebetween and ensure closure of the clasp. The locking elements are preferably formed as integral parts of the plastic strip. The female locking elements 28 and 30 may be formed on the inner surface of the first plastic strip 24, and the corresponding male element 32 formed on the first surface of the second plastic strip 22. The female locking elements 28 and 30 are spaced parallel to each other and form elongated concave locking groove surfaces. Preferably, the locking groove is a substantially "ʊ" shaped channel with its back an integral part of the plastic strip and its opening up. The male element 32 has elongated convex surfaces corresponding to the concave groove surfaces of the female element. Thus, when the male and female locking elements are pressed together the male element locks into the groove of the female members and so remains until separated by pulling the plastic strips apart as hereinafter described.

In operation, the baby's hair covering the desired baby head location for the baby hair adornment piece is positioned transversely between the female and male locking members. These locking members are then pressed together using a zipping action beginning at the welded end and ending at the opposite end. Such action drives the female member together with the baby's hair into locking engagement with the male member; there to remain until the zipping action is reversed. Although the male and female locking elements are easily disengaged using the reverse zipping action, it will be appreciated that, with the adornment piece glued to the center of the locking member, any force applied in a direction parallel to the locking members will be resisted by that portion of the locking members behind the directional force application point. Thus, an opening force applied to the adornment piece in any direction is resisted; in addition the close fit between the male and female members secures the device against hair slippage. In fact it has been found that entrapped hair on a person's arm will be pulled out before any slippage occurs.

The baby hair locking means can include several locks having common parts to conserve space, while adding or maintaining locking strength. To add additional locks, the first and second opposing flexible strips 22 and 24 have first, second, and third lock elements formed on their inner surfaces. The inner surface of the strip 24 has integrally formed thereon, for example, a pair of spaced elongated, flexible concave walls 28 and 30 forming a substantially "ʊ" shaped channel as described above with its opening positioned to receive the locking element 32. The channel arm forming walls 28 and 30 also have convex outer surfaces forming first and second locking (male) elements. While the inner surface of strip 22 has integrally formed thereon a first wall intermediate second and third walls. The first wall having convex surfaces forms the locking element 32 for the "ʊ" shaped channel which coact to form a first lock. In addition, the outer surfaces of the first wall 32 coact with concave inner surfaces of the second and third walls 34 and 36 to form substantially "ʊ" shaped second and third channels corresponding to the second and third locking elements 28 and 30 of the strip 22 to form therewith second and third locks.

Thus, when baby hair is passed through the first and second strips to extend transversely of their lengths and the strips pressed together, the baby hair is locked in the first, second, and third locks and the decorative baby hair piece is fixed to the baby hair.

Although several embodiments of this invention have been described, it will be apparent to a person skilled in the art that various modifications to the details of construction shown and described may be made without departing from the scope of this invention. For example, additional female and male locking members can be added for additional strength, the shape of the male and female locking surfaces may be changed, and the strip locations of the male and female members can be reversed with respect to the adornment piece.

What is claimed is:

1. A decorative baby hair piece comprising:

a decorative adornment means for beautifying a baby's hair;

a hair locking means attached to the decorative adornment means for securing the decorative adornment means to the baby's hair;

said hair locking means including: first and second elongated strips of flexible material, the strips having first and second opposing ends, the first ends being interconnected for forming first and second opposing surfaces, the second ends remaining open for positioning baby hair between the first and second strips; and strip locking means for locking the strips together, said strip locking means including elongated male and female elements of flexible material formed on opposing surfaces of the strips, said male and female elements extending substantially the length of the strips and having interlocking surfaces which coact when pressed together with the baby's hair inbetween to lock the corresponding surfaces and hair together for securing the decorative baby hair piece to the baby's hair, wherein the male element has oppositely disposed convex walls and the female element has concave walls corresponding to the convex walls of the male element for producing a lock when pressed together with a baby's hair inbetween for locking baby hair and the first and second strips together, and wherein the female element has convex shaped outer walls forming first and second parts of a second male element, and the male element has opposing members having concave surfaces forming first and second parts of a second female element, said first and second parts of the second male element corresponding to the first and second parts of the second female element for forming a second lock when pressed together.

2. A decorative baby hair piece comprising:

a hair locking means, and a decorative adornment means attached to the hair locking means;

said hair locking means including first and second opposing flexible plastic strips having inner and outer surfaces and first and second opposing ends, the first opposing ends being joined together, the first strip having walls depending from an inner surface for forming an elongated channel having opposing concave inner side surfaces and convex outer side surfaces, and the second strip having a first upwardly extending wall forming a first elongated member normal to an inner surface of the second strip having opposing convex outer surfaces corresponding to the concave inner side channel surfaces of the member of the first strip, and second and third walls forming a second elongated member with the first member therebetween and having opposite concave surfaces corresponding to the convex outer side channel surfaces of the member of the first strip, said elongated members for engaging the inner and outer walls of the channel of the first strip to lock corresponding surfaces together whereby when baby hair is positioned transversely therebetween and the two strips pressed together the corresponding surfaces lock the hair and first and second strips together.

* * * * *